US010881895B2

(12) United States Patent
Gubera

(10) Patent No.: US 10,881,895 B2
(45) Date of Patent: Jan. 5, 2021

(54) LEG TRAINING FITNESS DEVICE WITH DUMBBELL QUICK ATTACH MECHANISM

(71) Applicant: Evan Gubera, Fremont, CA (US)

(72) Inventor: Evan Gubera, Fremont, CA (US)

( * ) Notice: Subject to any disclaimer, the term of this patent is extended or adjusted under 35 U.S.C. 154(b) by 0 days.

(21) Appl. No.: 16/375,829

(22) Filed: Apr. 4, 2019

(65) Prior Publication Data

US 2019/0308056 A1 Oct. 10, 2019

Related U.S. Application Data

(60) Provisional application No. 62/653,296, filed on Apr. 5, 2018.

(51) Int. Cl.
*A63B 21/00* (2006.01)
*A63B 21/065* (2006.01)
(Continued)

(52) U.S. Cl.
CPC ..... *A63B 21/4015* (2015.10); *A63B 21/0004* (2013.01); *A63B 21/065* (2013.01);
(Continued)

(58) Field of Classification Search
CPC ..... A63B 21/0004; A63B 21/00058; A63B 21/00061; A63B 21/00065; A63B 21/00069; A63B 21/00072; A63B 21/00185; A63B 21/065; A63B 21/068; A63B 21/072; A63B 21/0726; A63B 21/075; A63B 21/08; A63B 21/15; A63B 21/159; A63B 21/4011; A63B 21/4013; A63B 21/4015; A63B 21/4023; A63B 21/4025; A63B 21/4027; A63B 21/4033;
(Continued)

(56) References Cited

U.S. PATENT DOCUMENTS 757,983 A * 4/1904 Vaile ..... A43B 5/00 36/114
2,114,790 A 4/1938 Venables ..... 272/57
(Continued)

FOREIGN PATENT DOCUMENTS

FR 1441529 A 6/1966
WO WO-2004085005 A2 10/2004

*Primary Examiner* — Gary D Urbiel Goldner
(74) *Attorney, Agent, or Firm* — Adibi IP Group, PC; Amir V. Adibi; Andrew C. Palmer

(57) ABSTRACT

A leg training fitness device comprises a weight attachment portion and a body attachment portion having a base support and a lateral support. To workout legs, a dumbbell is attached to the weight attachment portion. Next, a foot is inserted into the body attachment portion such that the foot is supported by the base support and the lateral support. A variety of leg workouts can be performed without requiring expensive and unwieldly equipment. Additionally, leg workouts are easily performed with the device without having to wait for leg workout machines to become available. In one embodiment, the foot is strapped to the body attachment portion and the dumbbell is strapped to the weight attachment portion. In another embodiment, the base and lateral supports rotate into an open and closed configuration that allows hooks attached to a lower surface of the base and lateral supports to clamp or release the dumbbell.

15 Claims, 15 Drawing Sheets

FITNESS DEVICE CLAMPING DUMBBELL

(51) Int. Cl.
*A63B 21/072* (2006.01)
*A63B 23/04* (2006.01)
*A63B 21/075* (2006.01)

(52) U.S. Cl.
CPC ..... *A63B 21/075* (2013.01); *A63B 21/0726* (2013.01); *A63B 21/4043* (2015.10); *A63B 23/04* (2013.01); *A63B 2225/09* (2013.01)

(58) Field of Classification Search
CPC ..... A63B 21/4034; A63B 21/4039; A63B 21/4043; A63B 21/4047; A63B 21/4049; A63B 23/035; A63B 23/03508; A63B 23/04; A63B 23/0494; A63B 23/08; A63B 23/085; A63B 2225/09; A63B 2244/09
See application file for complete search history.

(56) References Cited

U.S. PATENT DOCUMENTS 2,214,052 A * 9/1940 Good ..... A63B 21/4015 482/105
2,700,832 A * 2/1955 Slovinski ..... A43B 7/1465 36/140
3,343,836 A * 9/1967 James, Jr. ..... A63B 21/065 482/105
D264,736 S * 6/1982 Wolf ..... D2/911
4,497,314 A * 2/1985 Miller ..... A61H 1/0218 482/144
4,523,582 A 6/1985 Barber ..... 128/71
4,743,017 A * 5/1988 Jaeger ..... A63B 21/075 482/108
5,169,364 A 12/1992 Keith ..... 482/105
5,176,595 A * 1/1993 Lind ..... A63B 22/20 482/148
D368,289 S * 3/1996 Cotten ..... D21/683
5,722,919 A * 3/1998 Timmer ..... A63B 21/0004 482/105
5,935,047 A 8/1999 Cawley ..... 482/79
6,196,950 B1 3/2001 Emick ..... 482/105
8,876,123 B2 * 11/2014 Bradshaw ..... A43C 15/068 280/11.3
9,868,014 B1 * 1/2018 Lake ..... A63B 21/065
10,413,774 B2 * 9/2019 Weber ..... A63B 21/00061
10,583,323 B2 * 3/2020 Little ..... A63B 21/4015
2002/0119872 A1 * 8/2002 Greenheck ..... A63B 23/0494 482/93
2009/0131233 A1 * 5/2009 Seitzer ..... A63B 21/4015 482/105
2009/0192025 A1 * 7/2009 Minerva ..... A63B 21/4017 482/93
2010/0050477 A1 * 3/2010 Zeek ..... A43B 5/00 36/132
2011/0040225 A1 * 2/2011 Gibbons ..... A63B 21/00072 602/23
2012/0025479 A1 2/2012 Zeek ..... 280/11.31
2012/0028767 A1 * 2/2012 Zeek ..... A63B 21/0726 482/105
2012/0088640 A1 * 4/2012 Wissink ..... A63B 23/03541 482/110
2012/0225757 A1 * 9/2012 Kosich ..... A63B 21/4015 482/105
2015/0024908 A1 * 1/2015 Hall ..... A63B 21/4035 482/93
2015/0335935 A1 * 11/2015 Peralo ..... A63B 22/20 482/93
2016/0303417 A1 10/2016 Annino et al. ..... A63B 21/065
2018/0099174 A1 * 4/2018 Biggs ..... A63B 21/0728
2020/0094101 A1 * 3/2020 Long ..... A63B 21/4015

* cited by examiner

PERSPECTIVE VIEW OF FITNESS DEVICE

PERSPECTIVE VIEW OF FITNESS DEVICE WITH STRAPS

FRONT PERSPECTIVE VIEW OF FITNESS DEVICE
(ANOTHER EMBODIMENT)

REAR PERSPECTIVE VIEW OF FITNESS DEVICE

SIDE VIEW OF FITNESS DEVICE
(TRANSITIONING BETWEEN CLOSED AND OPEN CONFIGURATION)

CLOSED CONFIGURATION

OPEN CONFIGURATION

FITNESS DEVICE CLAMPING DUMBBELL

SIDE VIEW OF FITNESS DEVICE

BOTTOM VIEW OF FITNESS DEVICE

TOP VIEW OF FITNESS DEVICE

EXERCISING LEGS USING FITNESS DEVICE

PERFORMING HAMSTRING CURLS USING FITNESS DEVICE

PERFORMING LEG EXTENSIONS USING FITNESS DEVICE

FORMING AND PACKAGING A FITNESS DEVICE

PACKAGED FITNESS DEVICE

LEG TRAINING FITNESS DEVICE WITH DUMBBELL QUICK ATTACH MECHANISM

CROSS REFERENCE TO RELATED APPLICATIONS

This application claims the benefit under 35 U.S.C. § 119 from U.S. Provisional Patent Application Ser. No. 62/653,296, entitled "Legs Training Fitness Tool," filed on Apr. 5, 2018, the subject matter of which is incorporated herein by reference.

TECHNICAL FIELD

The described embodiments relate to fitness equipment, and more particularly, to fitness equipment enabling training of the legs and ankles in a convenient and cost-effective manner.

BACKGROUND INFORMATION

With increasing dependency on machines, the importance of exercise has dramatically increased. In recent years, regular physical exercise has become a permanent part of the life and is trending continuously. Regular exercise and stretching increases flexibility and helps keep the body in shape.

People perform different kind of exercises, but lower-body training is especially important for athletes and health focused people. Lower-body training is advantageous to stimulate upper-body muscle growth as leg workouts stimulate some of the largest muscles in body, which helps create a metabolic state that is conducive to muscle-building.

Exercising tools have been available for years in vast variety. These tools range from simple dumbbell to counterbalanced machines and to various motor driven tools. Usually, the tools to perform exercise for legs are complicated, heavy, expensive and occupy considerable floor space. People performing exercise at home might not have these leg training tools and might skip or underperform these exercises which results in incomplete body training routine. A solution that overcomes these challenges is desirable.

SUMMARY

A leg training fitness device comprises a body attachment portion and a weight attachment portion. The body attachment portion includes a base support and a lateral support. A user desiring to workout legs attaches a dumbbell of a desired weight to the weight attachment portion via a novel quick attach mechanism. Next, the user attaches his/her leg to the leg training fitness device by inserting his/her foot into the body attachment portion. After attaching to the body attachment portion, the foot is supported by the base support and the lateral support. The user is free to perform a variety of leg workouts without requiring expensive and unwieldly equipment.

In accordance with one novel aspect, the user is able to perform a wide range of leg exercises using the leg training fitness device without requiring an exercise facility. The novel leg training fitness device provides people an opportunity to have a complete full body gym work out with only dumbbells and the leg training fitness device. If the user is at a workout facility, then the user is able to perform a wide range of leg workouts using the device and without needing to wait for leg exercise machines to become available. This is particularly desirable at a workout facility where leg exercise machines tend to be crowded and have long wait times. On the other hand, dumbbells tend to be readily available at most exercise facilities and do not require significant space to utilize with the novel device.

In one embodiment, the body attachment portion and the weight attachment portion include strap mechanisms. Strap mechanisms are used to secure feet and legs to the training fitness device. Another strap mechanism is used to secure the dumbbell to the leg training fitness device.

In another embodiment, the base support and lateral support rotate into an open and closed configuration. The weight attachment portion includes a plurality of hooks disposed on a lower surface of the base support and lateral support. In the open configuration, the hooks open up thereby allowing the user to insert or release a clamped dumbbell or insert a new dumbbell into the hooks for clamping. In the closed configuration, the hooks close and clamp the dumbbell allowing the user to perform a variety of leg exercises. No straps or buckles are involved in securing the dumbbell to the leg training fitness device.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some exemplary embodiments of the invention, examples of which are illustrated in the accompanying drawings.

Figure 1:
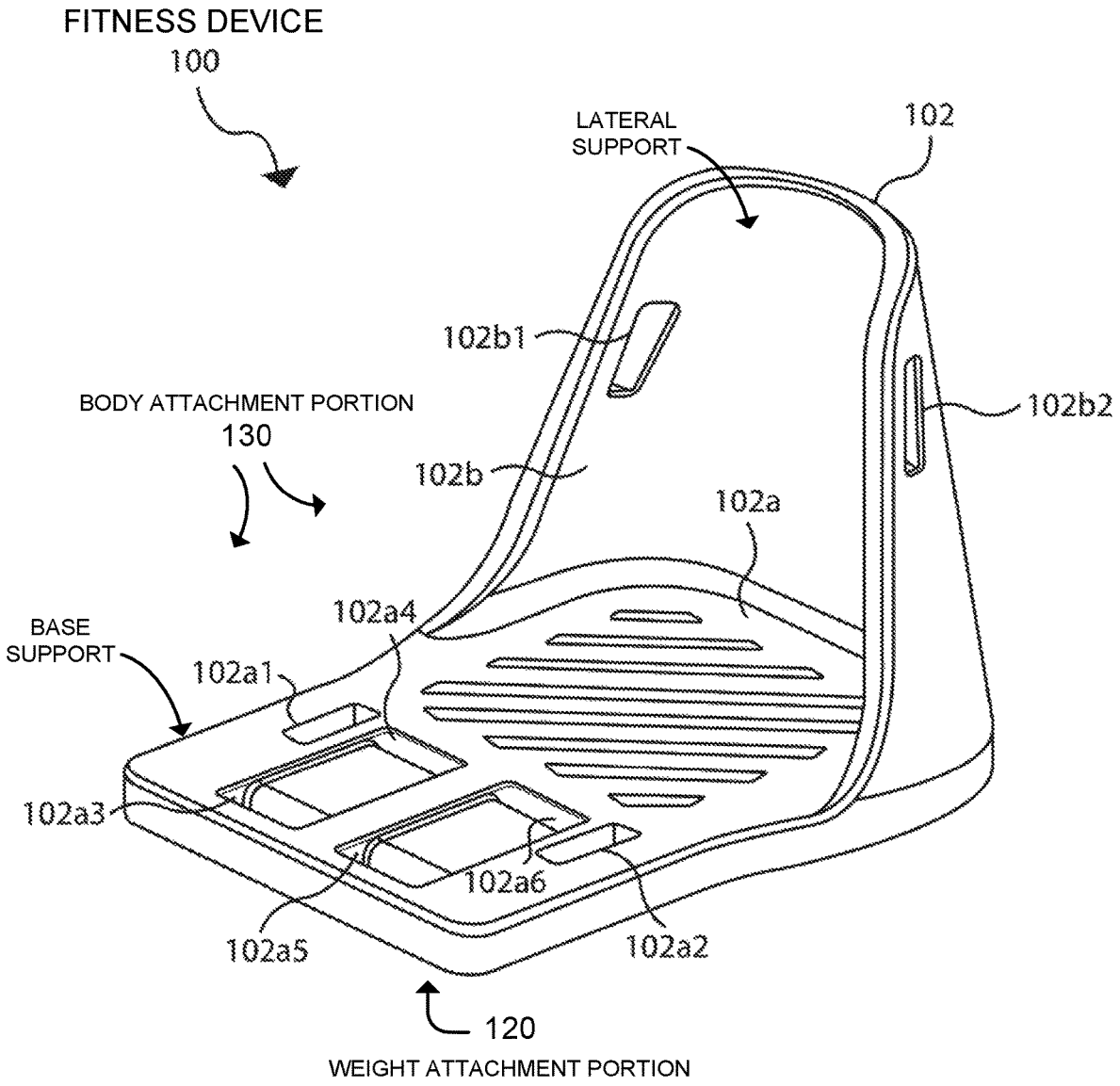
FIG. 1 is a diagram of a perspective view of the fitness device 100.

FIG. 1 is a diagram of a perspective view of the fitness device 100. The fitness device 100 is a leg training fitness device. The leg training fitness device 100 comprises a weight attachment portion 120 and a body attachment portion 130. An exercise weight such as a dumbbell is attached to the weight attachment portion 120. The body attachment portion 130 attaches to a foot of a user desiring to perform leg exercises. The user is able to utilize the fitness device 100 to exercise legs with varying weights of dumbbells and without the need for specialized, expensive, space consuming, movement limited, or scarcely available leg exercise equipment.

The fitness device 100 comprises a main body 102 having two surface including flat surface 102*a* and a cupping surface 102*b*. The flat surface 102*a* and a cupping surface 102*b* are integrally coupled together. In this example, the cupping surface 102*b* comprises two openings 102*b*1 and 102*b*2. The flat surface 102*a* comprises six openings 102*a*1, 102*a*2, 102*a*3, 102*a*4, 102*a*5, 102*a*6. In one example, the fitness device 100 is manufactured through injection molding techniques.

Figure 2:
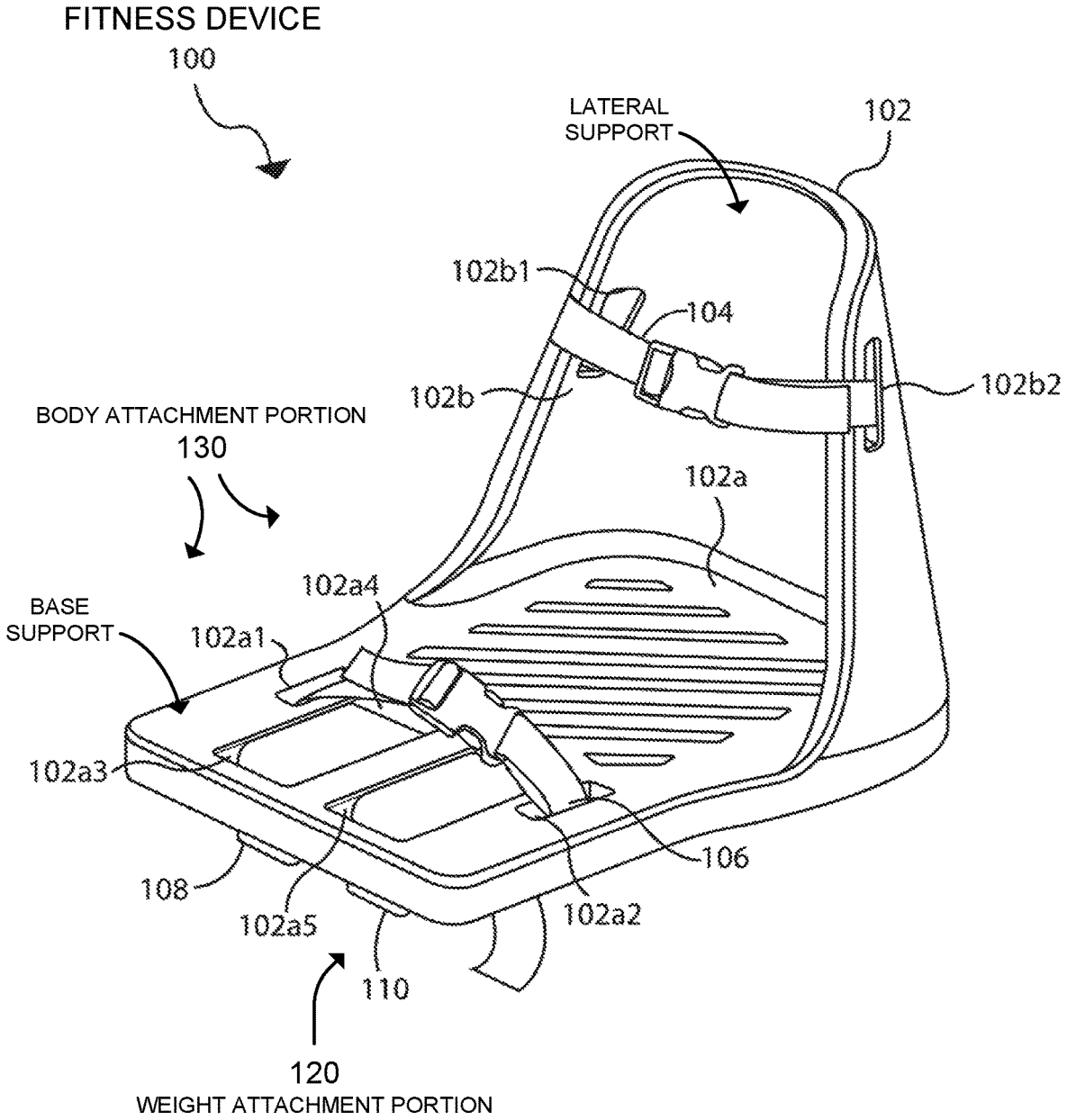
FIG. 2 is a diagram of side view of the fitness device 100.

FIG. 2 is a diagram of side view of the fitness device 100. The fitness device 100 includes a plurality of strap mechanisms involving straps and buckles. A strap mechanism 104 extends through the openings 102*b*1 and 102*b*2 of the cupping surface 102*b*. A strap mechanism 106 extends through the openings 102*a*1 and 102*a*2 of the flat surface 102*a*. A strap mechanism 108 extends through the openings 102*a*3 and 102*a*4 of the flat surface 102*a*. A strap mechanism 110 extends through the openings 102*a*5 and 102*a*6 of the flat surface 102*a*.

The strap mechanism 104 and the strap mechanism 106 are part of the body attachment portion 130 of the device 100. The strap mechanism 104 and the strap mechanism 106 are configured to secure a foot of the user into the fitness device 100. The strap mechanism 104 wraps around a lower leg portion of the user. The strap mechanism 106 wraps around a lower foot portion of the user.

The strap mechanism 108 and the strap mechanism 110 are part of the weight attachment portion 120 of the device 100. The strap mechanism 108 and the strap mechanism 108 are configured to attach a weight, such as a dumbbell, to the fitness device 100. The strap mechanisms 108 and 110 wrap around the weight and secure the weight to the fitness device 100.

Figure 3:
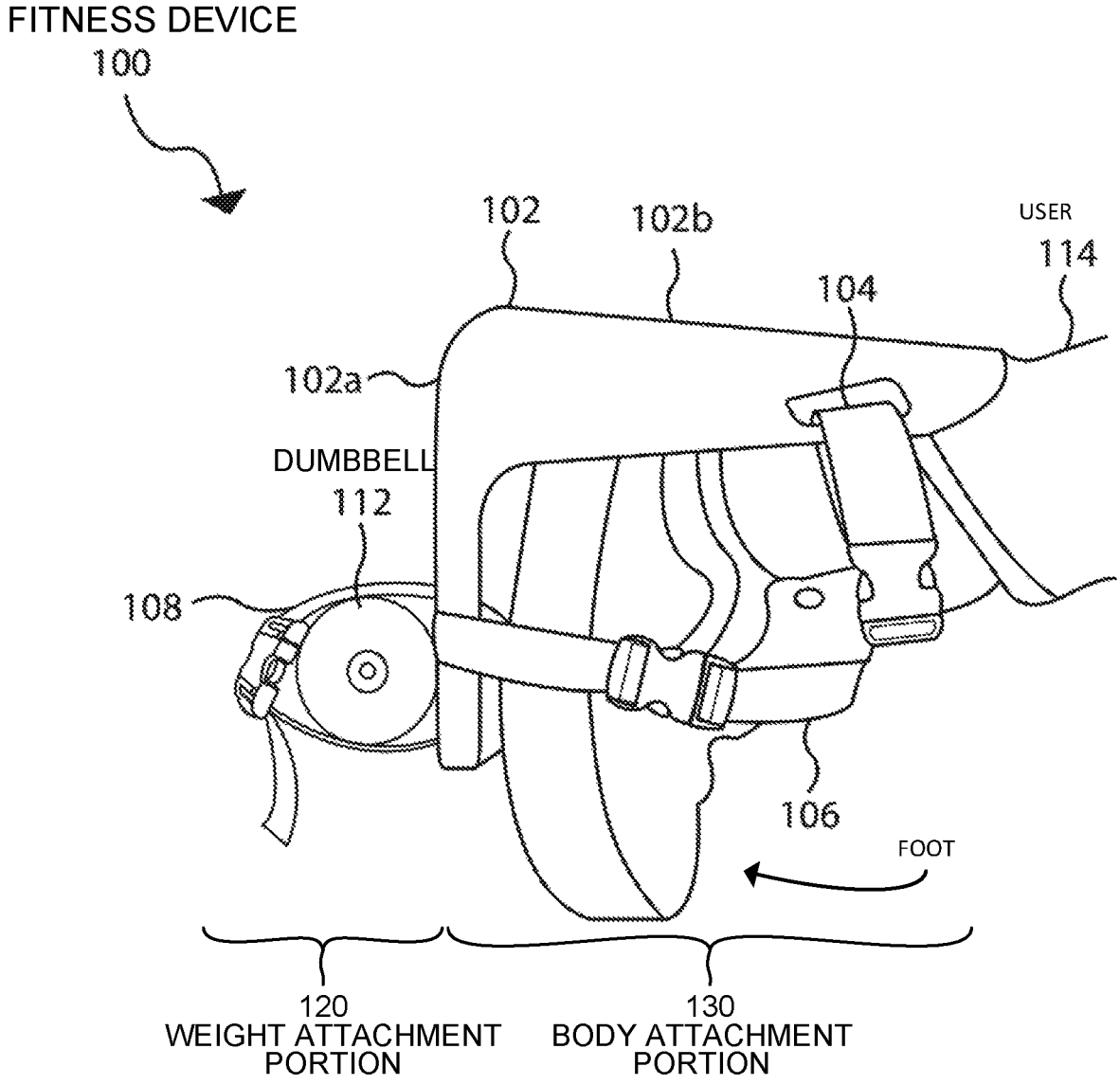
FIG. 3 is a diagram of another side view of the fitness device 100 with a weight 112 attached used by a user in performing leg exercises.

FIG. 3 is a diagram of another side view of the fitness device 100 with a weight 112 attached used by a user in performing leg exercises. The fitness device 100 is coupled to the weight 112 by the strap mechanisms 108 and 110 which secure the weight to the flat surface 102*a* of the device 100. The strap mechanisms 108 and 110 secure the weight 112 tightly to the leg training fitness device 100. The leg training fitness device 100 is coupled to the user 114 by coupling strap 104 of the cupping surface 102*b* to the leg of the user 114 and by coupling strap 106 of the flat surface 102*a* to the foot of the user 114. By employing the leg training fitness device 100, the user 114 is able to lift the weight 112 by using leg muscles and thereby perform leg training exercises in a convenient and cost-effective manner.

Figure 4:
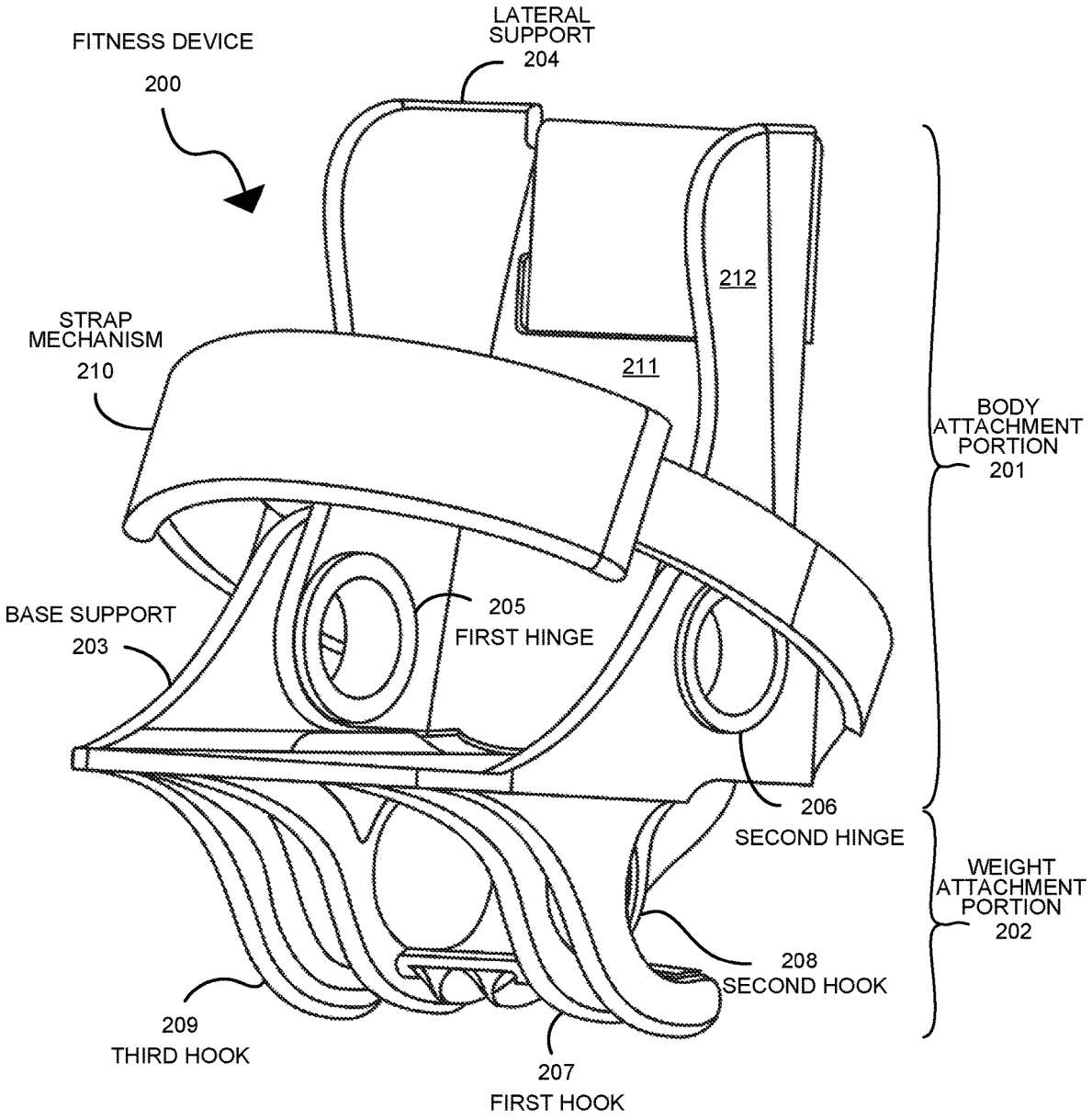
FIG. 4 is a diagram of a front perspective view of another embodiment of a fitness device 200.

FIG. 4 is a diagram of a front perspective view of another embodiment of a fitness device 200. The fitness device 200 is a leg training fitness device. The leg training fitness device 200 comprises a body attachment portion 201 and a weight attachment portion 202. The body attachment portion 201 comprises a base support 203, a lateral support 204, a first hinge 205, a second hinge 207, and a strap mechanism 210. The lateral support 204 includes an inner surface 211 and an outer surface 212. The base support 203 includes an inner surface 213 and an outer surface 214 (shown in FIG. 5). The weight attachment portion 202 comprises a first hook 207, a second hook 208, and a third hook 209. When the fitness device 200 is worn by the user, the user's leg and foot (through possible clothing and footwear) contact inner surfaces 211 and 213. A user performs leg exercises with the fitness device 200 by attaching an exercise weight, such as a dumbbell, to the weight attachment portion 202, by inserting their foot, with or without footwear, to the body attachment portion 201, and by performing leg movements while the fitness device 200 is worn.

In accordance with a first novel aspect, the base support 203 and the lateral support 204 are coupled together via the first hinge 205 and the second hinge 206. The base support 203 and the lateral support 204 rotate about the hinges 205,206 between an open configuration and a closed configuration. In this example, each of the first hinge 205 and the second hinge 206 is ring-shaped hinge with a hollow interior. The ring-shaped hinges 205,206 are press fit into respective openings of the base support 203 and the lateral support 204 thereby coupling together the base support 203 and the lateral support 204. The base support 203 and the lateral support 204 rotate about the ring-shaped hinges 205,206. The hinges 205,206 are formed from metal (for example, aluminum, titanium, or steel), injection molded plastic, or any other suitable material.

The hooks 207-209 open and close as the device 200 is switched between the open and closed configurations thereby allowing the user to attach or detach weights to the fitness device 200. The first hook 207 and the third hook 209 are attached to a lower surface of the base support 203. The second hook 208 is attached to a lower surface of the lateral support 204. To attach a weight, the fitness device 200 is switched to an open configuration so that the hooks 207-209 can receive the weight. Next, the weight is inserted into the hooks 207,209 or hook 208. Next, the fitness device 200 is switched to a closed configuration causing the weight to be clamped and held securely within the hooks 207-209. In FIG. 4, the fitness device 200 is in the closed configuration and no weight is shown.

Figure 5:
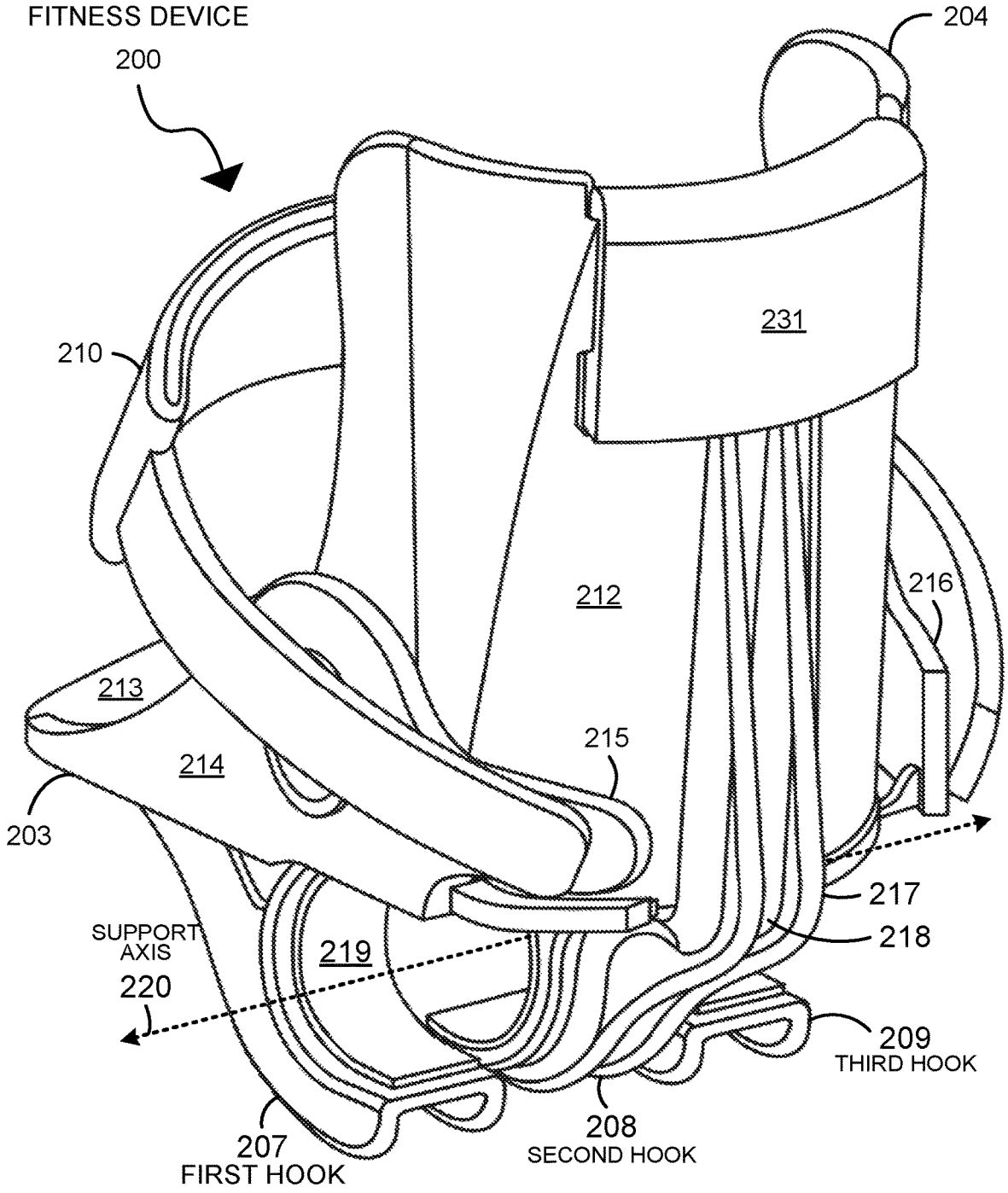
FIG. 5 is a diagram of a rear perspective view of the fitness device 200.

FIG. 5 is a diagram of a rear perspective view of the fitness device 200. This rear perspective view provides another view of the opening formed by the hooks 207-209. A support axis 220 extends through the opening formed by the hooks 207-209. The weight, or dumbbell, is held along the support axis 220. When a dumbbell is being clamped by the hooks 207-209, the dumbbell contacts a support surface of the hooks 207-209. Reference numeral 219 identifies a support surface of the first hook 207.

After placing his/her foot onto the base support 203 and resting the rear of the foot, ankle and calf against the lateral support 204, the strap mechanism 210 is employed to securely fasten the fitness device 200 to the user. The strap mechanism 210 attaches to ends 215 and 216 of the of the base support 203. The attachment of the strap mechanism 210 to the ends 215,216 of the base support 203 is performed by snap or press fit, mechanical fasteners (such as VELCRO), loop and tie buckles, clips, or any other suitable mechanism to attach the strap mechanism to the base support 203.

Additional support structures or cushioning mechanisms are included or excluded depending on the desired material strength and comfort of the fitness device 200. For example, support extrusions 217 and 218 are provided along the exterior surface 212 of the lateral support 204. A support panel 231 is provided along an upper portion of the exterior surface 212 of the lateral support 204 to support the user's leg during use of the fitness device 200. Additional cushion or support structures can be added to the fitness device 200.

Figure 6:
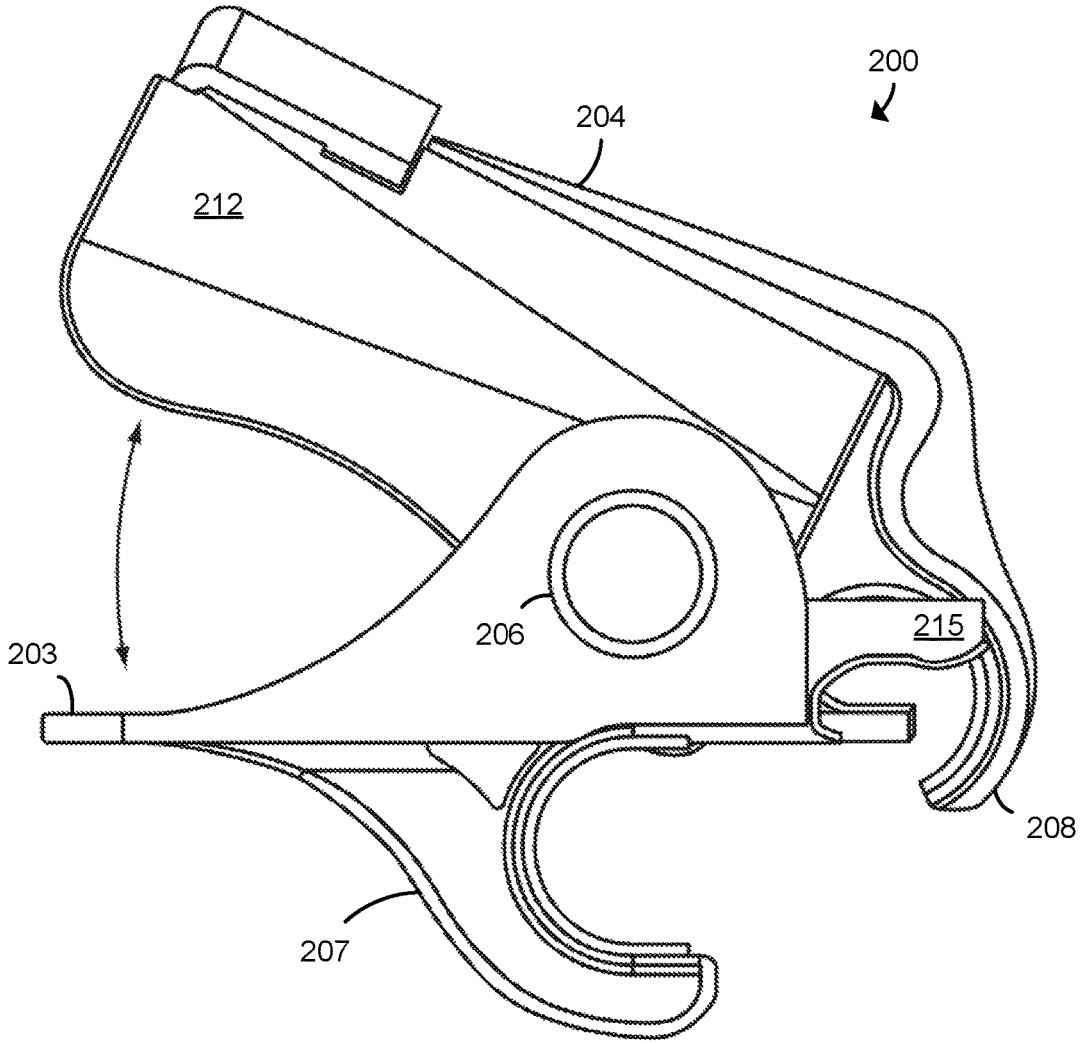
FIG. 6 is a diagram of a side view showing how the fitness device 200 transitions between open and closed configurations.

FIG. 6 is a diagram of a side view showing how the fitness device 200 transitions between open and closed configurations.

Figure 7:
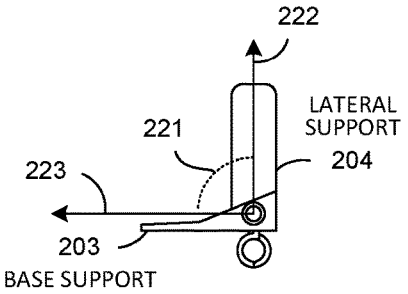
FIG. 7 is a simplified diagram of a side view of the fitness device 200 in the closed configuration.

FIG. 7 is a simplified diagram of a side view of the fitness device 200 in the closed configuration. In the closed configuration, the hooks 207-209 are clamped shut. Reference numeral 222 identifies a first axis and reference numeral 223 identifies a second axis. The first axis 222 and the second axis 223 form an angle 221. In the closed configuration, the angle 221 is approximately ninety degrees (90°). In other examples, in the closed configuration, the angle 221 is between seventy degrees (70°) and one-hundred and ten degrees (110°).

Figure 8:
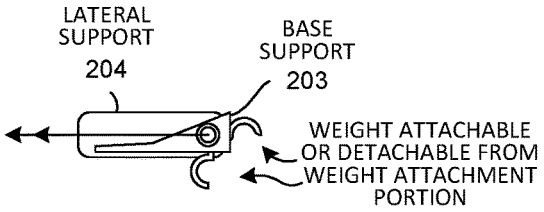
FIG. 8 is a simplified diagram of a side view of the fitness device 200 in the open configuration.

FIG. 8 is a simplified diagram of a side view of the fitness device 200 in the open configuration. In the open configuration, the hooks 207-209 are open. Weights are attached or detached from the hooks as desired. To transition the fitness device 200 from the closed configuration to the open configuration, the lateral support 204 is rotated towards the base support 203. To transition the fitness device 200 from the open configuration to the closed configuration, the lateral support 204 is rotated away from the base support 203.

Figure 9:
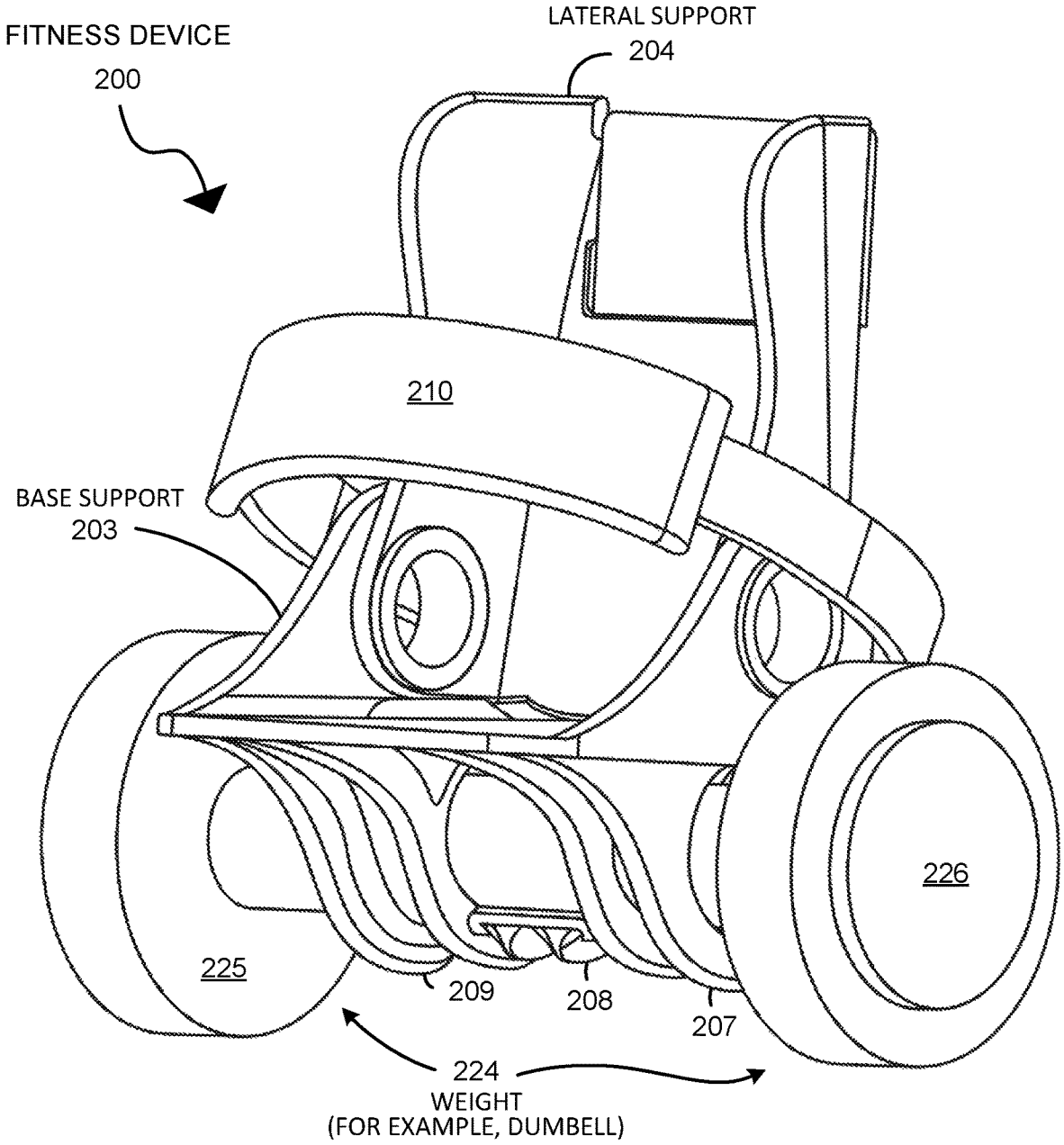
FIG. 9 is a diagram of a front perspective view of the fitness device 200 clamping a weight 224 in the closed configuration.

FIG. 9 is a diagram of a front perspective view of the fitness device 200 clamping a weight 224 in the closed configuration. In this example, the weight 224 is a dumbbell. The dumbbell 224 includes a first weight bell 225, a second weight bell 226, and a dumbbell dowel 227 that connects both bells 226,227. In the closed configuration, the dumbbell dowel 227 is clamped in place by the hooks 207-209 thereby securely attaching the dumbbell 224 to the fitness device 200.

Figure 10:
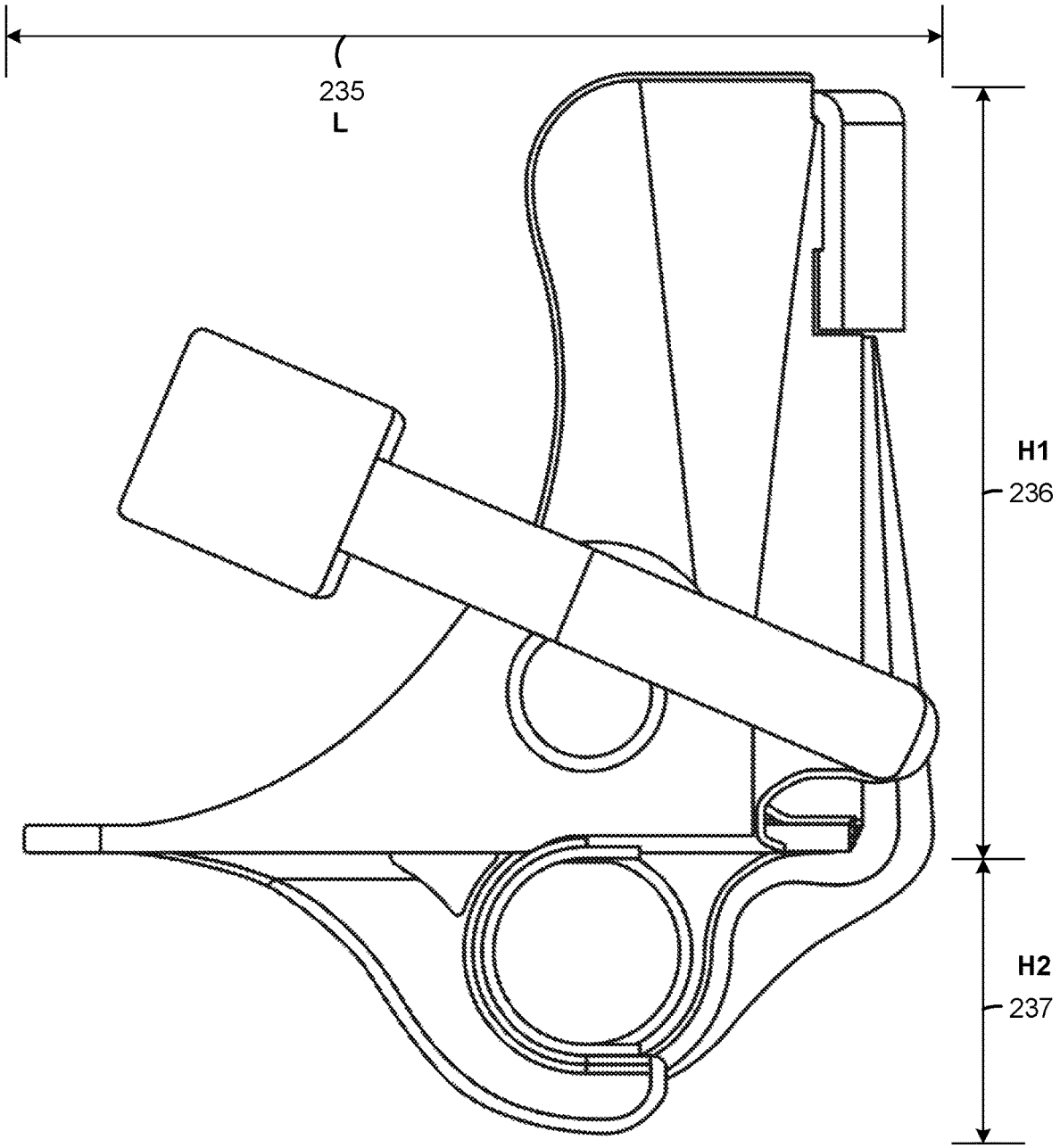
FIG. 10 is a diagram of a side view showing various dimensions of the fitness device 200.

FIG. 10 is a diagram of a side view showing various dimensions of the fitness device 200. Reference numeral 235 identifies a length dimension (L). Reference numeral 236 identifies a height dimension (H1) of the body attachment portion 201. Reference numeral 237 identifies a height dimension (H2) of the weight attachment portion 202. To provide substantial support to the foot and leg, the length L 235 of the body attachment portion 201 is greater than the height H1 236 of the body attachment portion 201. To maximize support of weight and maintain optimal foot and leg support during lifting, the height H1 236 of the body attachment portion 201 is at least twice the height H2 237 of the weight attachment portion 202. In one specific embodiment, length L 235 of the body attachment portion 201 is approximately 170 millimeters, the height H1 236 of the body attachment portion 201 is approximately 140 millimeters, and the height H2 237 of the weight attachment portion 202 is approximately 55 millimeters.

Figure 11:
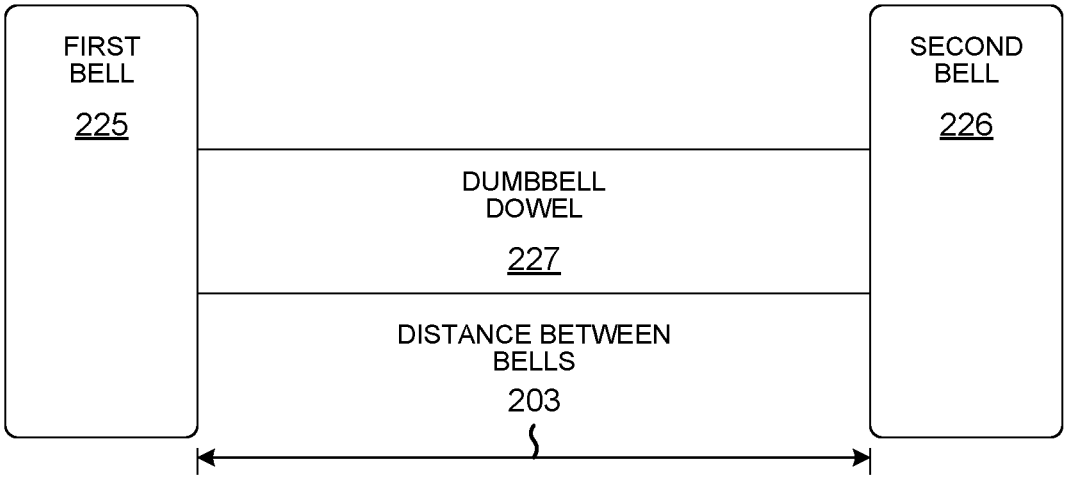
FIG. 11 is a diagram of a top view of the dumbbell 224.

FIG. 11 is a diagram of a top view of the dumbbell 224. Reference numeral 228 identifies a distance between first and second bells 225 and 226. The distance 228 between the first and second bells 225 and 226 in commercially available dumbbells tends to be greater than one-hundred and twenty-seven millimeters (127.0 mm). The fitness device 200 is sized appropriately to fit all standard dumbbell sizes commonly found at most exercise facilities.

Figure 12:
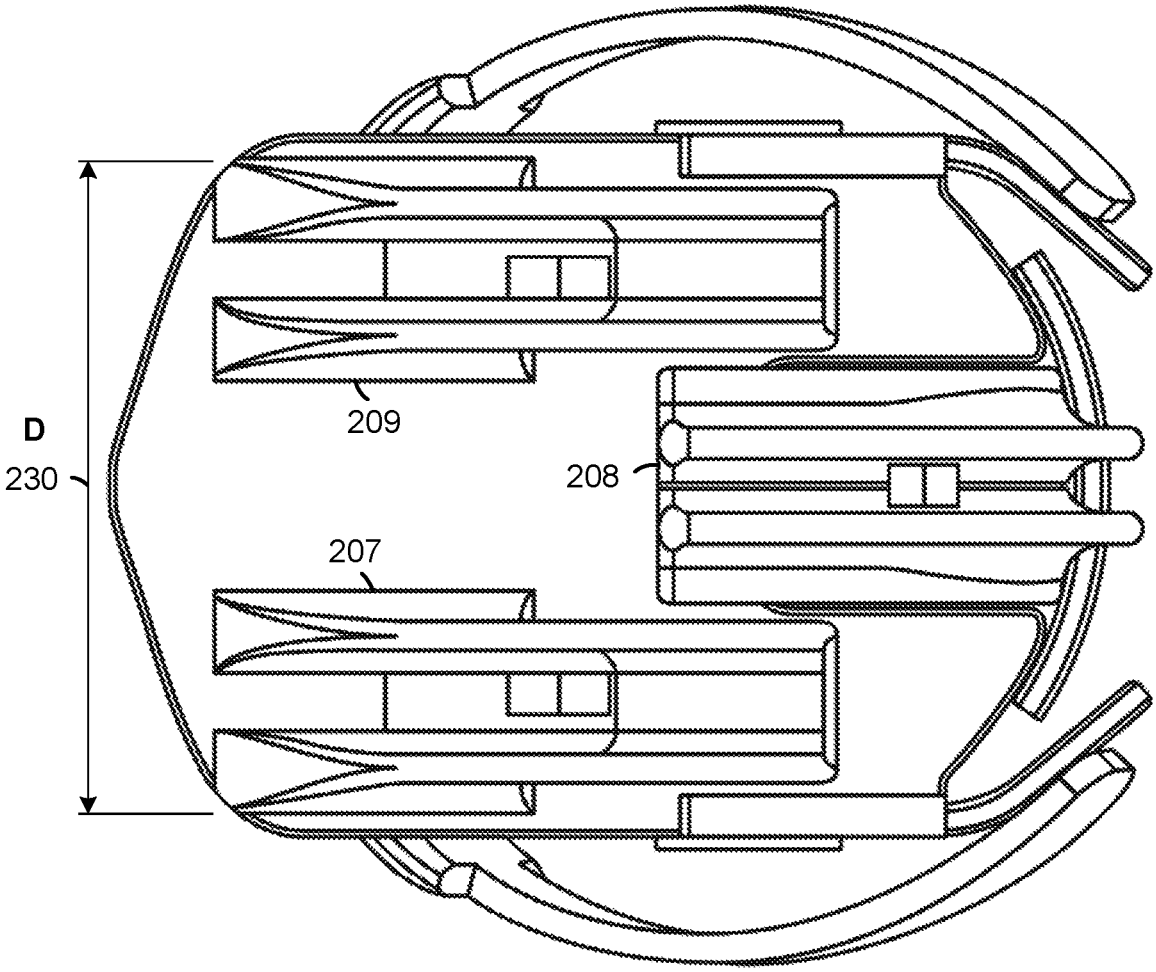
FIG. 12 is a diagram of a bottom view of the fitness device 200.

FIG. 12 is a diagram of a bottom view of the fitness device 200. Reference numeral 230 identifies a distance (D) from an outer edge of the first hook 207 to the outer edge of the second hook 209. The distance D 230 is less than one-hundred and twenty-seven millimeters (127 mm) to provide support for a wide range of conventionally available dumbbells. If the distance D 230 were to be greater than one-hundred and twenty-seven millimeters (127 mm), then the bells 225,226 of most commercially available dumbbells would obstruct placement of the dowel 227 within the hooks 207,209. To provide optimal leg support for heavier weights, the distance D 230 between edges of hooks 207,209 is greater than the height H2 237 of the weight attachment portion 202, and the distance D 230 between edges of hooks 207,209 is less than the length L 235 and less than the height H1 236 of the body attachment portion 201. In one specific embodiment, the distance D 230 between edges of hooks 207,209 is one-hundred and eight millimeters (108 mm). It will be appreciated that embodiments of the invention may be made to allow use with dumbbells with different dimensions. Thus, for example, D 230 may be greater than about 127 mm if the spacing of the bells so allows.

Figure 13:
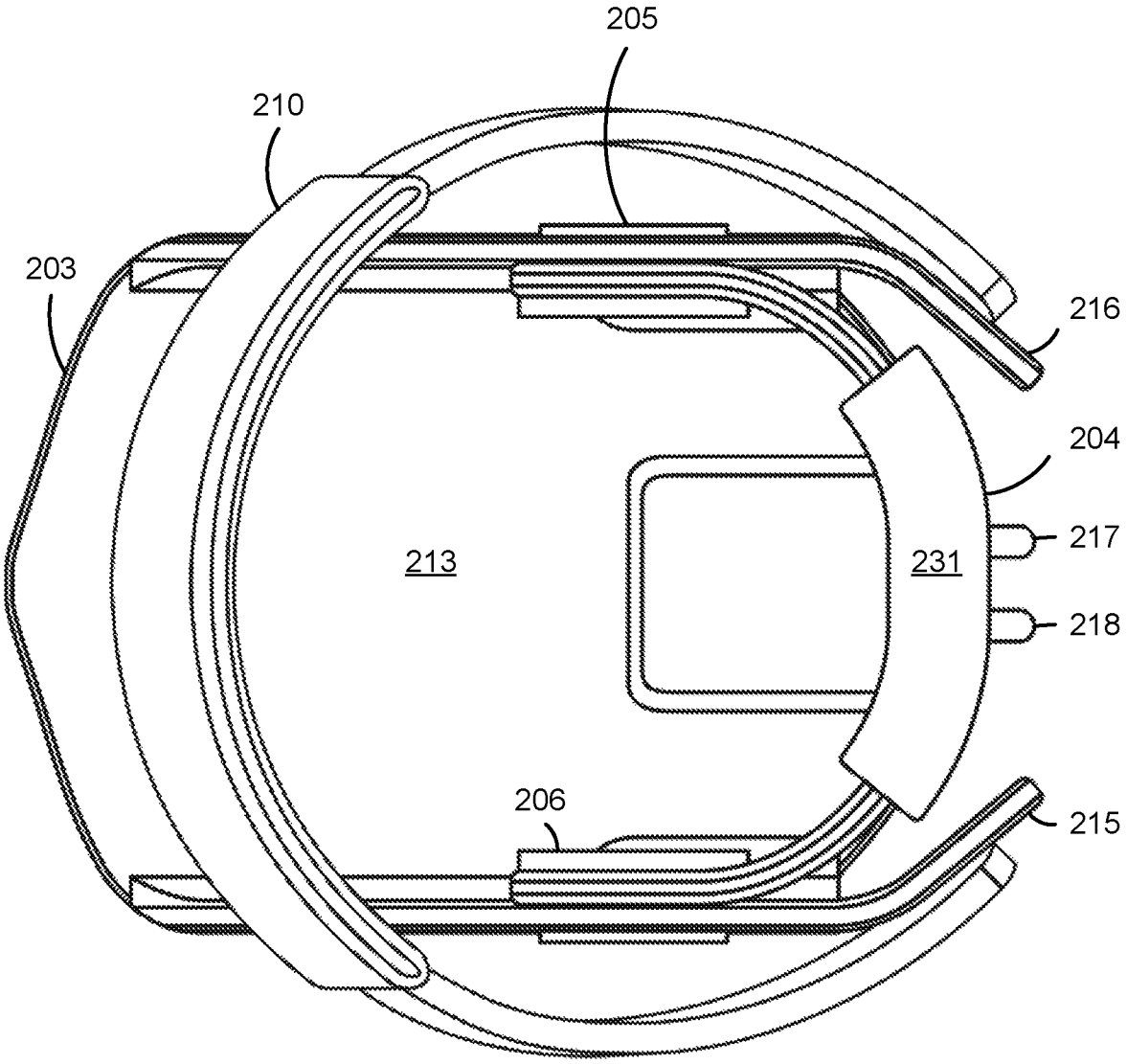
FIG. 13 is a diagram of a bottom view of the fitness device 200.

FIG. 13 is a diagram of a bottom view of the fitness device 200. During use, a foot of the user is inserted into and fits within the inside of the base support 203.

Figure 14:
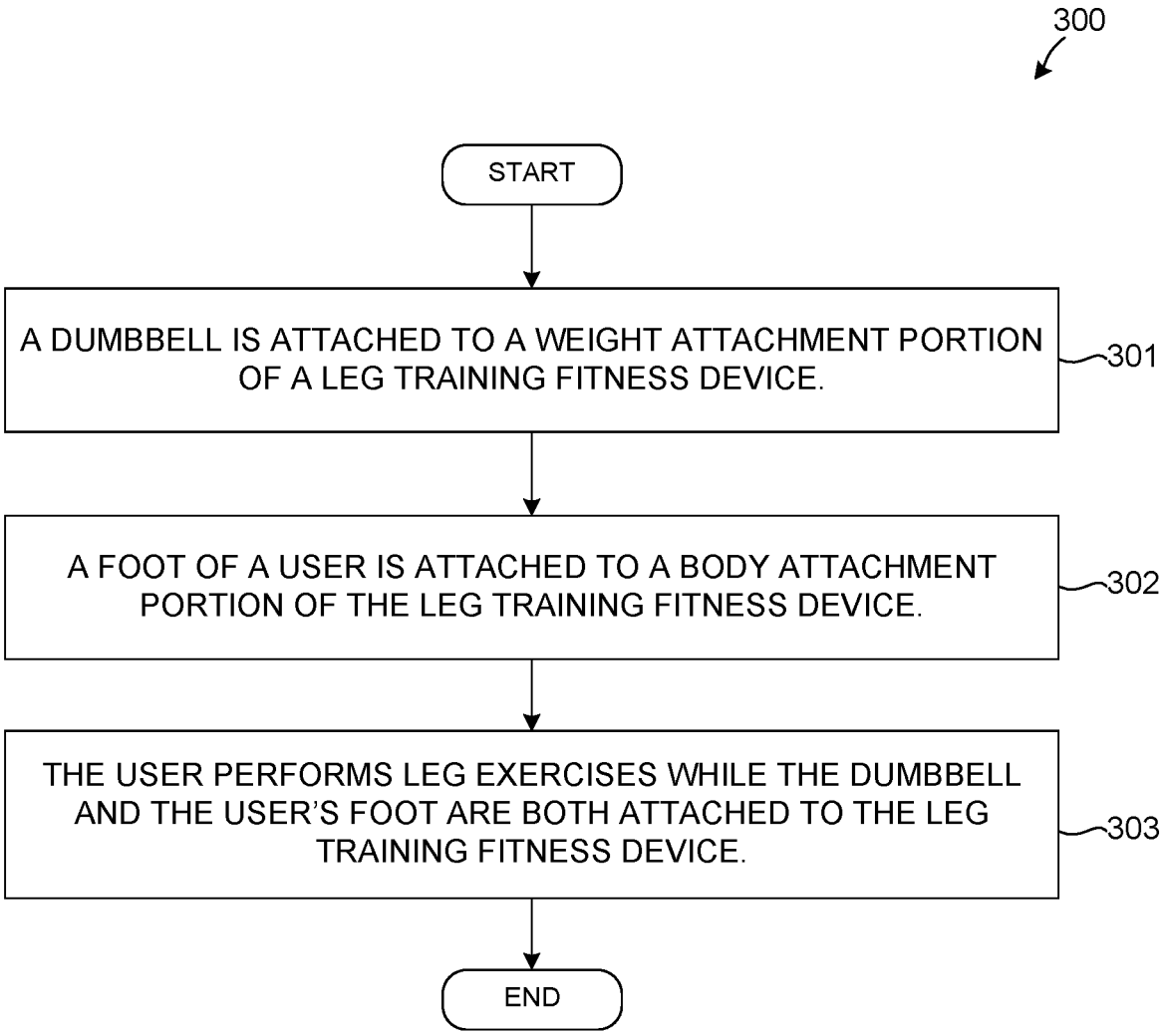
FIG. 14 is a flowchart of a method 300 in accordance with one novel aspect.
Figure 15:
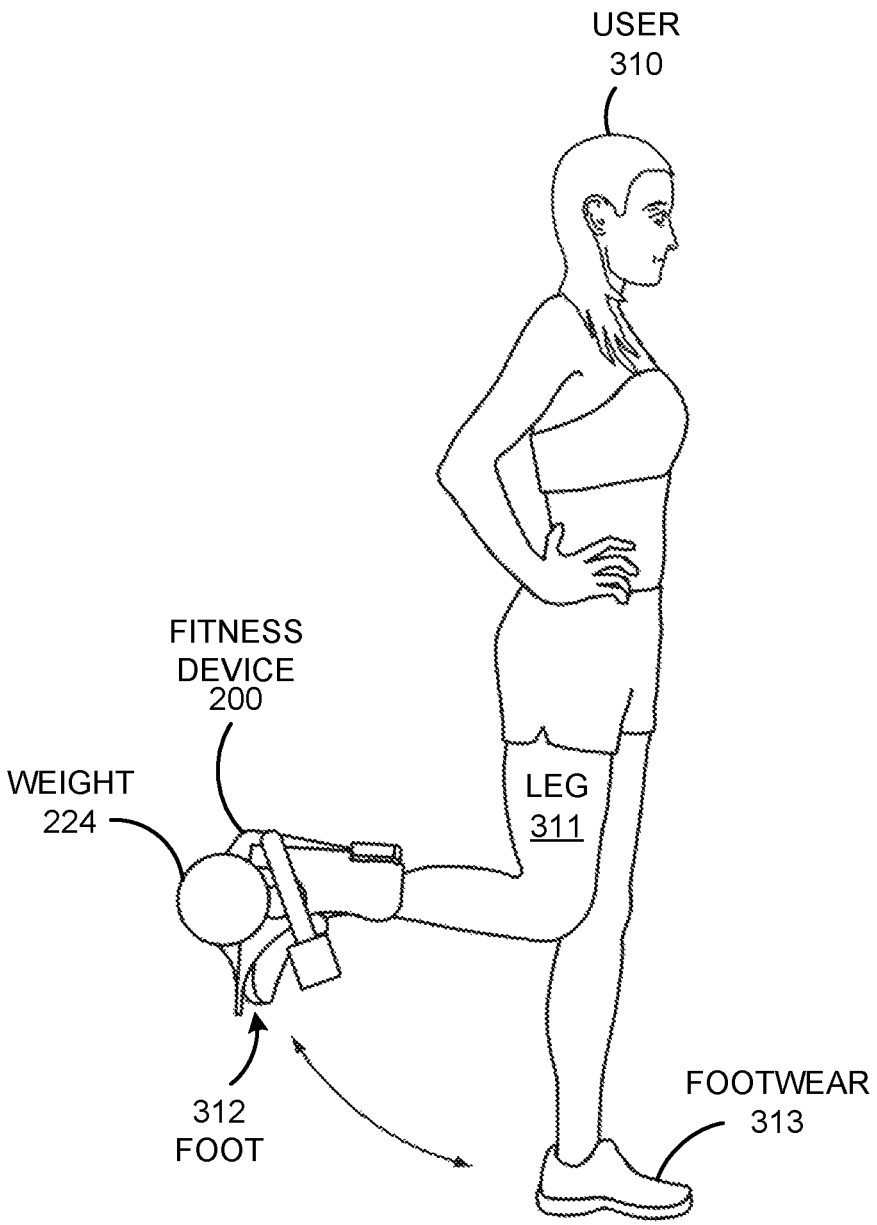
FIG. 15 is a diagram of a perspective view showing how a uses the fitness device 200 to perform hamstring curls.
Figure 16:
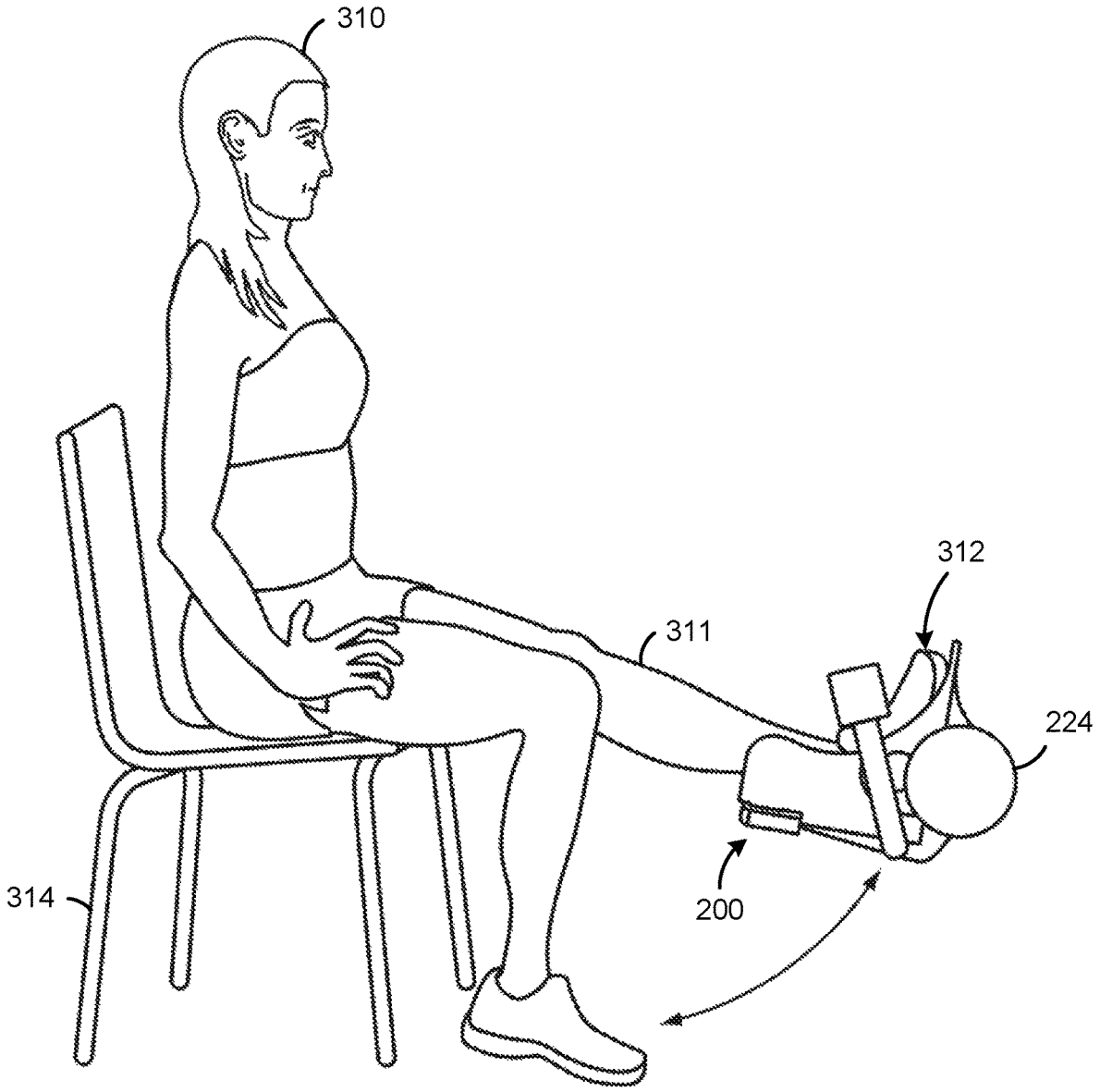
FIG. 16 is a diagram of a perspective view showing how a uses the fitness device 200 to perform leg extensions.

FIG. 14 is a flowchart of a method 300 in accordance with one novel aspect. In a first step (step 301), a dumbbell is attached to a weight attachment portion of a leg training fitness device. In a second step (step 302), a foot of a user is attached to a body attachment portion of the leg training fitness device. In a third step (step 303), the user performs leg exercises while the dumbbell and the user's foot are both attached to the leg training fitness device. In the example of FIG. 15, a user 310 performs hamstring curls using the fitness device 200 thereby exercising leg 311. Foot 312 is secured within the fitness device 200 and dumbbell 224 is attached to the fitness device 200. The user 310 is wearing footwear 313. The fitness device 200 is operated with or without footwear 313. In the example of FIG. 16, the user 310 sits on chair 314 and performs leg extensions using the fitness device 200.

Figure 17:
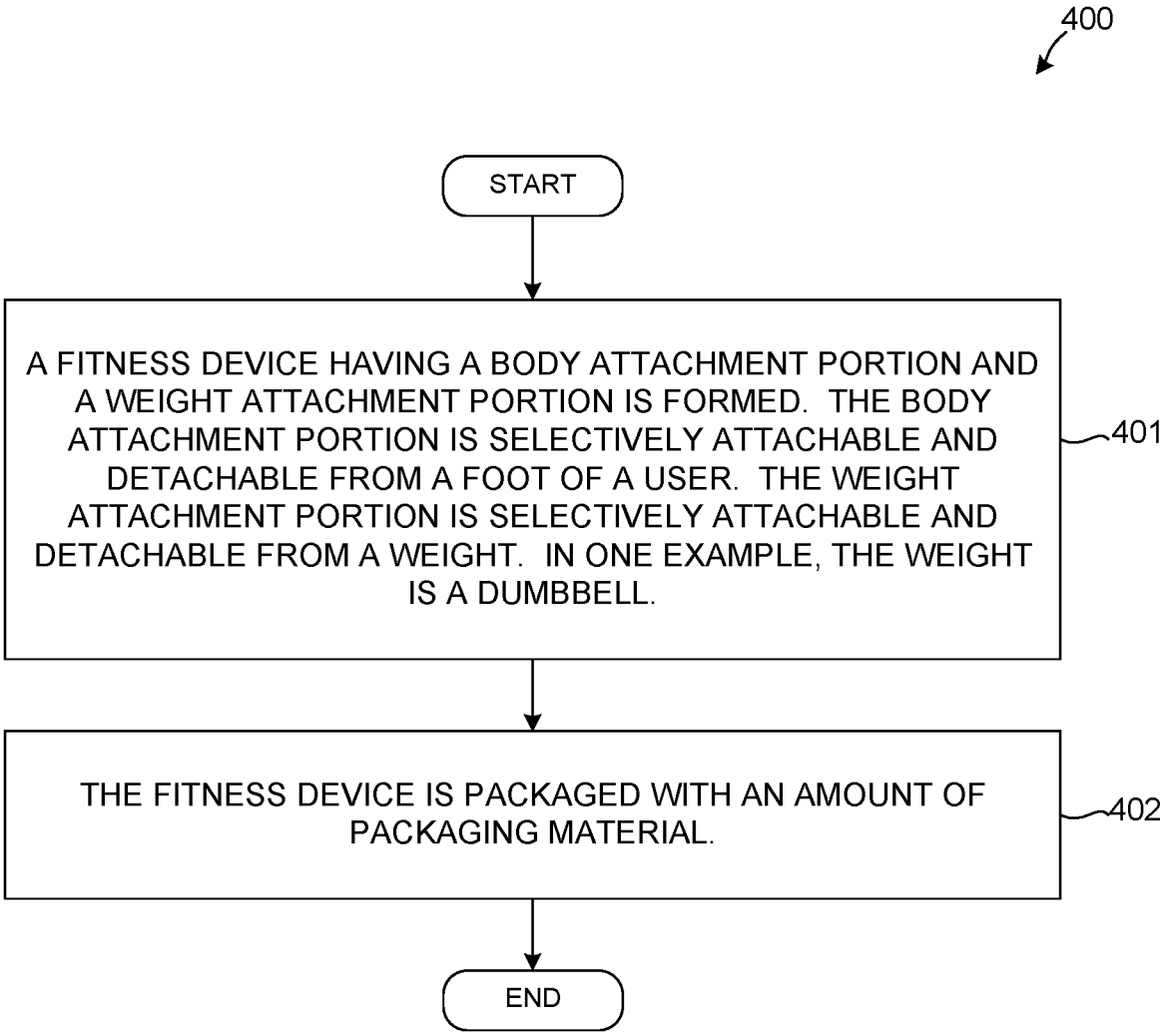
FIG. 17 is a flowchart of a method 400 in accordance with another novel aspect.

FIG. 17 is a flowchart of a method 400 in accordance with another novel aspect. In a first step (step 401), a fitness device having a body attachment portion and a weight attachment portion is formed. The body attachment portion is selectively attachable and detachable from a foot of a user. The weight attachment portion is selectively attachable and detachable from a weight. In one example, the weight is a dumbbell.

Figure 18:
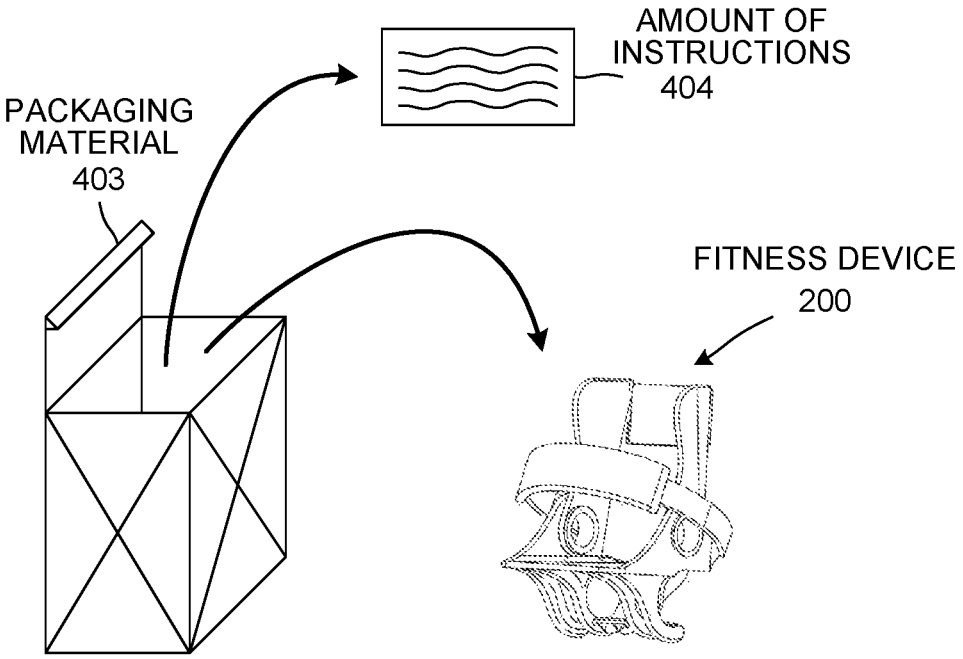
FIG. 18 is a diagram of a perspective view showing how the fitness device 200 is packaged within packaging material 403 along with an amount of instructions 404.

In a second step (step 402), the fitness device is packaged with an amount of packaging material. In the example of FIG. 18, the fitness device 200 is packaged within packaging material 403 along with an amount of instructions 404. The amount of instructions 404 instruct a user on how to attach weights to the fitness device, how to the fitness device to the foot, and how to perform leg exercises using the fitness device.

Although certain specific exemplary embodiments are described above in order to illustrate the invention, the invention is not limited to the specific embodiments. Accordingly, various modifications, adaptations, and combinations of various features of the described embodiments can be practiced without departing from the scope of the invention as set forth in the claims.

What is claimed is:

1. A leg training fitness device comprising:

a body attachment portion configured to be attachable to and detachable from a foot of a user; and a weight attachment portion, wherein a weight is attachable to the weight attachment portion, and wherein the weight is detachable from the weight attachment portion, wherein the body attachment portion comprises a base support and a lateral support, and wherein the base support and the lateral support rotate between an open configuration and a closed configuration, wherein the weight attachment portion comprises a plurality of hooks, wherein a first of the plurality of hooks is disposed on a lower surface of the base support, and wherein a second of the plurality of hooks is disposed on a lower surface of the lateral support.

2. The leg training fitness device of claim 1, wherein the body attachment portion comprises a first surface and a second surface, wherein when the body attachment portion is attached to the foot, and wherein the first surface is configured to support a bottom of the foot and the second surface is configured to support a rear of the foot.

3. The leg training fitness device of claim 2, wherein the body attachment portion is configured to be attached to footwear within which the foot is disposed, wherein when the body attachment portion is attached to the foot the first surface is configured to contact a sole of the footwear and the second surface is configured to contact a rear of the footwear.

4. The leg training fitness device of claim 2, wherein the first surface and the second surface are substantially perpendicular, wherein the first surface is flat, and wherein the second surface is curved.

5. The leg training fitness device of claim 1, wherein the body attachment portion further comprises at least one strap mechanism configured to secure the foot to the body attachment portion.

6. The leg training fitness device of claim 1, wherein the base support and the lateral support rotate around a hinge axis, wherein in the open configuration, the weight attachment portion opens such that the weight is attachable or detachable from the weight attachment portion, wherein in the closed configuration, the weight attachment portion clamps the weight such that the weight is secured within the weight attachment portion and such that the body attachment portion is configured to receive the foot.

7. The leg training fitness device of claim 1, wherein the base support and the lateral support are separate structures connected by at least one hinge.

8. The leg training fitness device of claim 1, wherein the first of the plurality of hooks and the base support are integrally formed as a single and unitary structure, and wherein the second of the plurality of hooks and the lateral support are integrally formed as a single and unitary structure.

9. The leg training fitness device of claim 1, wherein the weight is a dumbbell, and wherein a distance between two outermost hooks of the plurality of hooks is less than one-hundred and twenty-seven millimeters.

10. A method comprising the steps of:

(a) attaching a dumbbell to a weight attachment portion of a leg training fitness device; and (b) attaching a foot of a user to a body attachment portion of the leg training fitness device, wherein the body attachment portion comprises a base support element and a lateral support element, wherein the base support element and the lateral support element are coupled together via at least one hinge, and wherein the attaching of step in (a) involves:

(a1) rotating the base support element and the lateral support element towards each other thereby providing access to hooks of the weight attachment portion;

(a2) attaching the dumbbell to the hooks of the weight attachment portion; and (a3) rotating the base support element and the lateral support element away from each other thereby clamping the dumbbell within the hooks of the weight attachment portion.

11. The method of claim 10, wherein the attaching step in (b) involves using a strap mechanism to secure the foot to the body attachment portion of the leg training fitness device.

12. The method of claim 10, further comprising:

(c) performing leg exercises while the dumbbell and the foot are both attached to the leg training fitness device.

13. An apparatus comprising:

a foot support having an inner surface and an outer bottom surface, wherein the outer bottom surface is opposite the inner surface, and wherein the foot support is configured to be attachable to a foot of a user such that the foot of the user is supported by the inner surface; and means for selectively attaching and detaching a weight to the outer bottom surface of the foot support.

14. The apparatus of claim 13, wherein the apparatus is a leg training fitness device, wherein the weight is a dumbbell, wherein the means comprises a plurality of hooks, wherein when the apparatus is in an open configuration, the plurality of hooks open to accept the weight, and wherein when the apparatus is in a closed configuration, the plurality of hooks close around the weight thereby clamping the weight to the apparatus.

15. The apparatus of claim 13, wherein the apparatus is a leg training fitness device, wherein the weight is a dumbbell, wherein the means comprises a strap mechanism that extends into openings along the foot support, and wherein the strap mechanism is configured to wrap around the weight and secure the weight to the apparatus.

* * * * *